US009332854B2

(12) United States Patent
Slusher, II

(10) Patent No.: US 9,332,854 B2
(45) Date of Patent: May 10, 2016

(54) COIL SPRING BRACKET

(71) Applicant: England, Inc., Monroe, MI (US)

(72) Inventor: Monroe B. Slusher, II, New Tazewell, TN (US)

(73) Assignee: England, Inc., Monroe, MI (US)

( * ) Notice: Subject to any disclaimer, the term of this patent is extended or adjusted under 35 U.S.C. 154(b) by 0 days.

(21) Appl. No.: 14/495,072

(22) Filed: Sep. 24, 2014

(65) Prior Publication Data

US 2015/0285431 A1 Oct. 8, 2015

Related U.S. Application Data

(60) Provisional application No. 61/974,028, filed on Apr. 2, 2014.

(51) Int. Cl.

| | |
|---|---|
| ***A47C 23/05*** | (2006.01) |
| ***A47C 23/30*** | (2006.01) |
| ***A47C 23/04*** | (2006.01) |
| ***A47C 23/16*** | (2006.01) |
| ***A47C 27/06*** | (2006.01) |
| ***A47C 7/30*** | (2006.01) |
| ***A47C 7/34*** | (2006.01) |

(52) U.S. Cl.

CPC . *A47C 23/30* (2013.01); *A47C 7/30* (2013.01); *A47C 7/34* (2013.01); *A47C 23/04* (2013.01); *A47C 23/16* (2013.01); *A47C 27/067* (2013.01)

(58) Field of Classification Search

CPC ..... A47C 7/35; A47C 23/05; A47C 23/0507; A47C 23/30

USPC ..... 5/717, 721, 723; 297/452.5; 267/86, 88, 267/91, 95, 97, 100, 101

See application file for complete search history.

(56) References Cited

U.S. PATENT DOCUMENTS

| | | | | | |
|---|---|---|---|---|---|
| 466,302 | A | * | 12/1891 | Henry | A47C 23/002 267/100 |
| 1,096,801 | A | * | 5/1914 | D'Arcy | A47C 23/05 5/264.1 |
| 1,815,510 | A | * | 7/1931 | Hotter | A47C 23/30 5/239 |
| 2,234,253 | A | * | 3/1941 | Hopkes | A47C 7/35 267/102 |
| 2,305,530 | A | * | 12/1942 | Hopkes | A47C 7/35 222/248 |
| 3,334,887 | A | * | 8/1967 | Slominski | A47C 23/30 267/110 |
| 3,489,404 | A | * | 1/1970 | Poovey | A47C 7/347 267/101 |

(Continued)

*Primary Examiner* — Thomas Irvin

(74) *Attorney, Agent, or Firm* — Harness, Dickey & Pierce, P.L.C.

(57) ABSTRACT

A coil spring bracket assembly that supports a cushion on a furniture frame is disclosed. A flat spring spans the furniture frame along a support plane to support the cushion. A cross member spanning the furniture frame is aligned with and spaced from the flat spring. A helical spring extends from the cross member to the flat spring to bias the flat spring toward the support plane. A bracket is disposed at opposite ends of the cross member to anchor the cross member to the furniture frame. The bracket includes a top portion that extends outwardly over the furniture frame along the support plane, a middle portion that extends from the top portion into the furniture frame, and a bottom portion that extends inwardly from the middle portion to abut a portion of the cross member in overlapping relationship.

25 Claims, 7 Drawing Sheets

(56) References Cited

U.S. PATENT DOCUMENTS 4,244,089 A * 1/1981 Cavaler ..... A47C 23/043 29/432
4,886,250 A * 12/1989 Lucas ..... A47C 7/35 267/100
5,232,266 A * 8/1993 Mork ..... A47C 7/24 297/440.22
D348,162 S * 6/1994 Issacs ..... D6/718.31
5,538,325 A * 7/1996 Bullard ..... A47C 31/05 297/440.22
5,570,874 A * 11/1996 Tornero ..... F16F 1/08 267/100
D383,022 S * 9/1997 Barber ..... D6/718.31
6,170,915 B1 * 1/2001 Weisz ..... A47C 7/35 267/87
6,832,401 B2 * 12/2004 Setzer ..... F16F 3/10 267/94

* cited by examiner

COIL SPRING BRACKET

CROSS-REFERENCE TO RELATED APPLICATIONS

This application claims the benefit of U.S. Provisional Application No. 61/974,028, filed on Apr. 2, 2014. The entire disclosure of the above application is incorporated herein by reference.

FIELD

The present disclosure generally relates to the fields of upholstery, seating, furniture, and mattresses. More particularly, a coil spring bracket apparatus is disclosed for supporting a cushion.

BACKGROUND

Cushions are commonly utilized to make seating, furniture, mattresses and the like more comfortable for the consumer. Often, cushions are simply installed on a hard support surface and little thought goes into how the cushion is supported. Without such consideration, inferior levels of comfort are achieved. Further, cushions that are placed on a hard support surface may degrade over time and become flattened, compacted, hard, lumpy, or thinned in critical areas. To prevent this from occurring, superior designs support the cushion on a furniture frame. Such furniture frames are commonly rectangular in shape and present an open interior. In this way, the cushion can be displaced into the open interior when force is applied to the cushion. Such force may be applied when a consumer sits or lies against the cushion. Accordingly, the cushion can maintain its approximate shape and thickness and is not compressed between the consumer and a hard support surface.

To prevent the cushion from sagging into the open interior of the furniture frame when force is not being applied to the cushion, such designs commonly utilize flat springs that spans the furniture frame. The cushion is disposed on top of the flat springs such that the flat springs support the cushion on the furniture frame. An alternative design utilizes helical springs that extend upwardly toward the cushion from a cross member that is disposed within the open interior of the furniture frame. The cross member spans the furniture frame and thus supports the helical springs within the open interior of the furniture frame. The benefit of these designs is that when the consumer gets up and the force is removed from the cushion, the flat springs or the helical springs force the cushion back up and out of the open interior of the furniture frame.

However, problems do exist with these upholstery designs. They are difficult to assemble because access to the open interior of the furniture frame can be limited and installation of the flat springs, helical springs, and/or cross member can be awkward and time consuming. Further, these designs place a lot of stress on the flat springs or the helical springs and their mounting locations on the furniture frame and/or the cross member. This stress over time can break the flat springs or the helical springs and can cause the fasteners used to secure these spring to break or pull out. Accordingly, a more robust design that is easier to install is needed.

SUMMARY

The present disclosure provides a coil spring bracket assembly that meets these demands and provides superior support. The disclosed coil spring bracket assembly supports a cushion on a furniture frame and includes at least one flat spring spanning the furniture frame. The at least one flat spring extends along a support plane. The cushion is supported by the at least one flat spring and is supported on the support plane. The coil spring bracket assembly includes at least one cross member spanning the furniture frame that extends between two opposite ends. The at least one cross member is aligned with and spaced from the at least one flat spring. The coil spring bracket assembly also includes at least one helical spring extending from the at least one cross member to the at least one flat spring to bias the at least one flat spring toward the support plane. Accordingly, the at least one cross member supports the at least one helical spring and the at least one helical spring supports the at least one flat spring. The coil spring bracket apparatus further includes a bracket disposed at each of the two opposite ends of the at least one cross member. The bracket thus anchors the at least one cross member to the furniture frame. The bracket generally includes a top portion, a middle portion, and a bottom portion. The top portion of the bracket extends outwardly over the furniture frame along the support plane. The middle portion of the bracket extends from the top portion of the bracket into the furniture frame and the bottom portion of the bracket extends inwardly from the middle portion of the bracket to abut a portion of the at least one cross-member in an overlapping relationship.

The disclosed coil spring bracket assembly is thus a very robust design because the bracket takes considerable stress off of the fasteners, the two opposite ends of the at least one cross member, and the portions of the furniture frame where these components are attached. Accordingly, component failures are less likely and product life is increased. Further, the disclosed design couples the at least one flat spring with the at least one helical spring such that both act in concert to counteract forces that are applied to the cushion. Thus, the disclosed design provides superior cushion support without compromising comfort or the lifespan of the cushion. Finally, the disclosed coil spring bracket apparatus is easier to assemble. The at least one helical spring may be attached to the at least one cross member and a bracket may be attached to each of the two opposite ends of the at least one cross member all before the apparatus is installed in the furniture frame. Accordingly, the coil spring bracket apparatus may be prefabricated when there is good access to all of the components and then the apparatus can be easily installed in the furniture frame with minimal effort. Advantageously, this reduces labor time and ultimately decreases cost.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
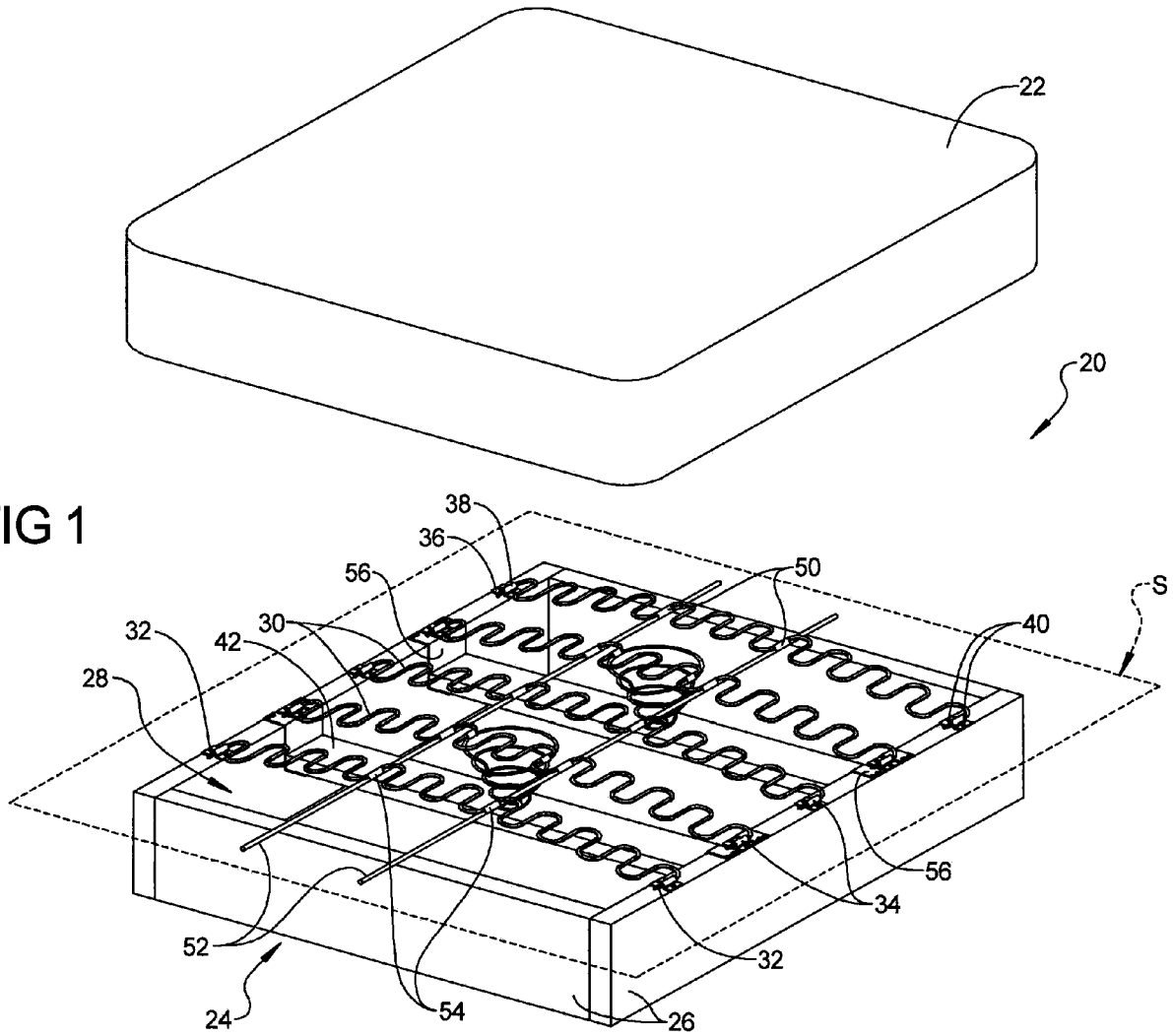
FIG. 1 is a front perspective view of an exemplary coil spring bracket apparatus constructed in accordance with the present disclosure.

Referring to the Figures, wherein like numerals indicate corresponding parts throughout the several views, a coil spring bracket apparatus 20 is disclosed. Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," "top," "middle," "bottom," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptors used herein interpreted accordingly.

Referring to FIG. 1, the disclosed coil spring bracket apparatus 20 may generally be used to support a cushion 22 on a furniture frame 24. The cushion 22 may take many forms including without limitation a cushion 22 for a chair, seat, couch, sofa, recliner, stool, bench, bed, mattress, box-spring, and like furniture. Accordingly, it should be appreciated that the term "cushion" is intended to encompass any form of padding. The furniture frame 24 generally supports the cushion 22 and may be separate from or integral with the cushion 22. It should be appreciated that the term "furniture frame" as used herein describes any frame for supporting a cushion 22. Accordingly, the term "furniture frame" is not intended to be limited to household furniture, but encompasses any frame that supports a cushion 22 including, but not limited to, indoor furniture, outdoor furniture, seating used in vehicles, seating used in public places, seating used in arenas (e.g. stadiums, theaters, movie theaters, churches, auditoriums, etc.), and beds. The frame generally includes one or more support members 26 with the cushion 22 resting on or being fixed to these one or more support members 26. The furniture frame 24, including the one or more support members 26 may be made of sheets of plywood. As shown in FIG. 1, the one or more support members 26 of the furniture frame 24 may generally give the furniture frame 24 a rectangular shape with an open interior 28. The cushion 22 is then placed above the furniture frame 24.

Still referring to FIG. 1, the coil spring bracket apparatus 20 includes at least one flat spring 30 that spans the furniture frame 24. The at least one flat spring 30 generally follows a sinusoidal shape and extends between two opposite ends 32. The at least one flat spring 30 is disposed along and defines a support plane S. Where the support plane S is substantially horizontal as shown in FIG. 1, the cushion 22 is disposed above the support plane S. Accordingly, the cushion 22 may rests on top of the at least one flat spring 30 and be supported thereon. Of course it should be appreciated that the support plane S may have a variety of different orientations and the support plane S itself may be flat, bent, curved, or contoured. The cushion 22 is generally supported on the support plane S regardless of orientation; however, there may be intermediary layers or elements disposed between the cushion 22 and the support plane S. While a variety of materials may be used, by way of example and without limitation, the at least one flat spring 30 can be made of wire, and more specifically metal wire that has a circular cross-section. Due to its construction and composition, the at least one flat spring 30 is elastic and resilient such that it may stretch and/or be deflected when acted on by a force and then spring back to its initial length and/or position when the force is removed. This may occur for example when a person sits or lies on the cushion 22. It should be appreciated that the at least one flat spring 30 of the coil spring bracket apparatus 20 may be a plurality of flat springs 30 spaced across the furniture frame 24. In the example shown in FIG. 1, the at least one flat spring 30 includes five flat springs 30 arranged parallel to each other and spaced evenly across the furniture frame 24.

Still referring to FIG. 1, a spring clip 34 is disposed at each of the two opposite ends 32 of the at least one flat spring 30. The spring clip 34 anchors each of the two opposite ends 32 of the at least one flat spring 30 to the furniture frame 24. While the spring clip 34 may take many forms, by way of example, the spring clip 34 may include a clip base 36 that is flat and rectangular and a channel 38 that protrudes upwardly from the clip base 36. The channel 38 of the spring clip 34 receives a portion of the at least one flat spring 30 and clamps that portion of the at least one flat spring 30 against the furniture frame 24. The clip base 36 of the spring clip 34 may define at least one hole 40 for receiving a fastener. The fastener anchors the spring clip 34 to the furniture frame 24. The at least one hole 40 of the spring clip 34 may be a pair of holes 40 that extend through the clip base 36 on opposite sides of the channel 38. As such, fasteners may be inserted into the pair of holes 40 in the clip base 36 to anchor the spring clip 34 to the furniture frame 24 on each side of the at least one flat spring 30. It should be appreciated that such fasteners may take a variety of forms, including without limitation, screws, bolts, nails, staples, pins, and rivets.

Figure 2:
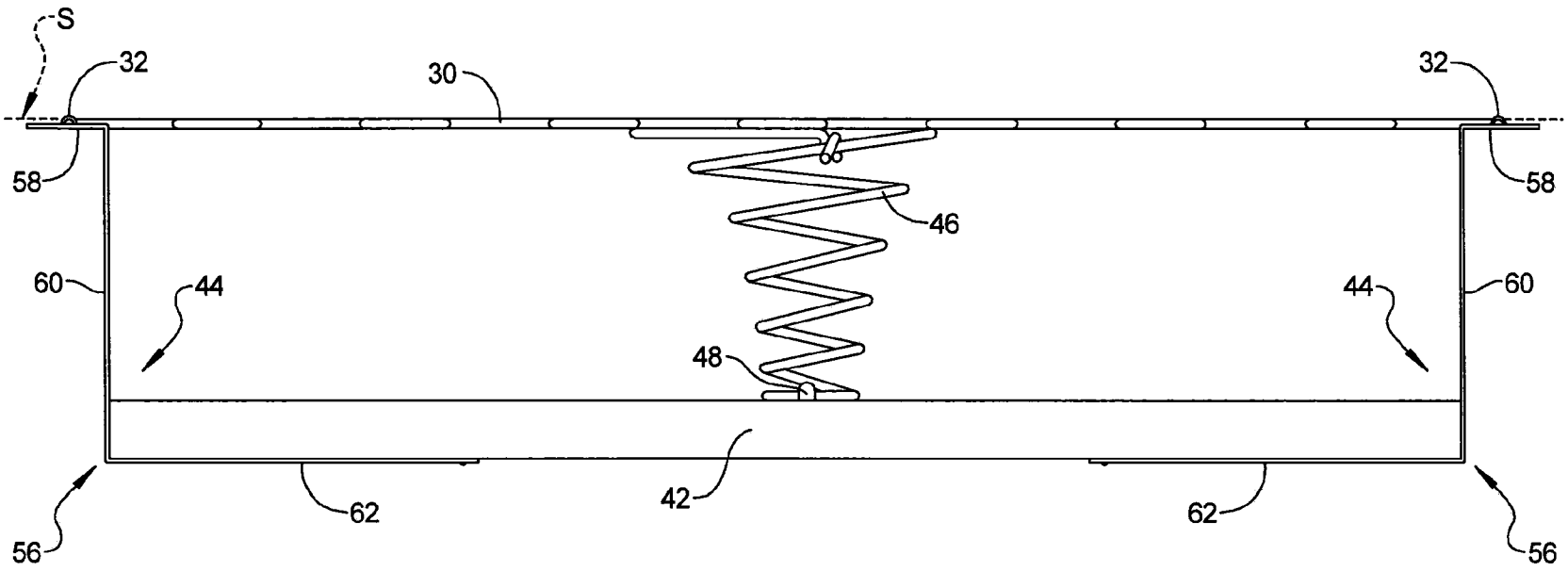
FIG. 2 is a side elevation view of the exemplary coil spring bracket apparatus shown in FIG. 1.
Figure 3:
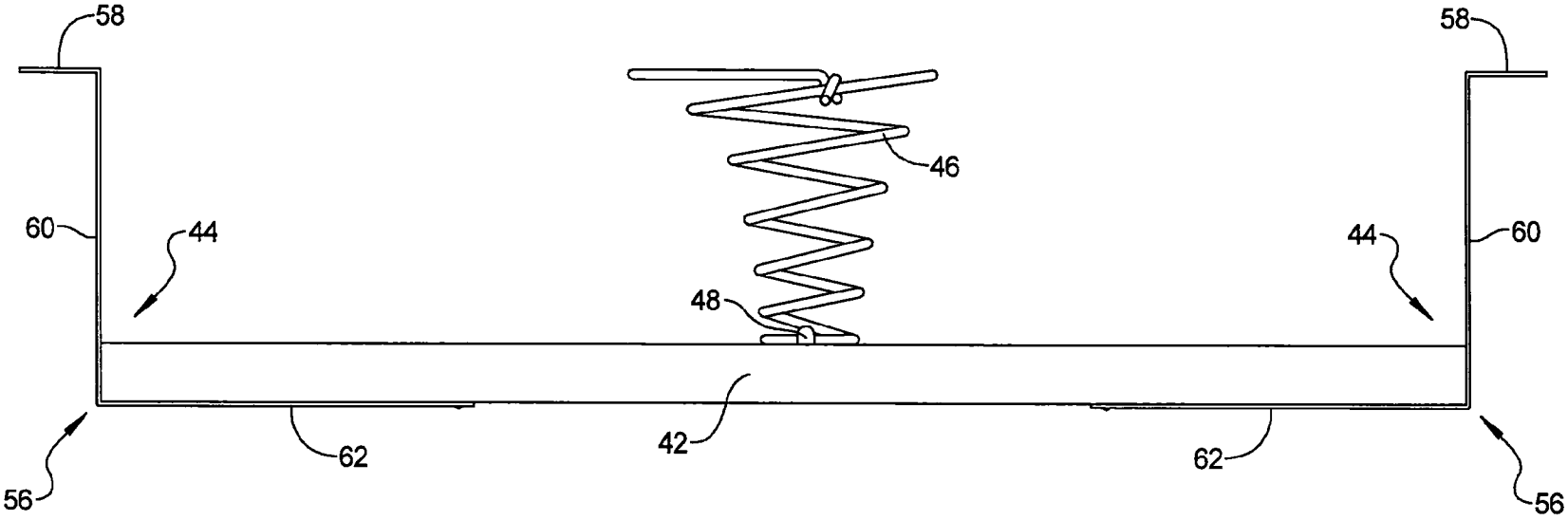
FIG. 3 is a side elevation view of the exemplary coil spring bracket apparatus shown without the at least one flat spring.

As seen in FIG. 1, the coil spring bracket apparatus 20 includes at least one cross member 42 that spans the furniture frame 24. The at least one cross member 42 is disposed in the open interior 28 of the furniture frame 24 and may generally be aligned with and spaced from the at least one flat spring 30. Further, the at least one cross member 42 may generally extend in a direction that is parallel to the support plane S. As best seen in FIGS. 2 and 3, the at least one cross member 42 extends between two opposite ends 44. While the at least one cross member 42 may be made of a variety of materials, by way of example and without limitation, the at least one cross member 42 may be made of plywood. It should be appreciated that the at least one cross member 42 of the coil spring bracket apparatus 20 may be a plurality of cross members 42. As can be seen in FIG. 1, the at least one cross member 42 may be a plurality of cross members 42 corresponding to and vertically aligned with every other flat spring 30 of the plurality of flat springs 30. In the example shown in FIG. 1, only the even numbered flat springs 30 (when counting sequentially from left to right) of the plurality of flat springs 30 have a corresponding cross member 42. Since the cross members 42 are aligned with their corresponding flat springs 30, the cross members 42 of the plurality of cross members 42 are parallel to each other and evenly spaced apart.

As best seen in FIGS. 2 and 3, the coil spring bracket apparatus 20 includes at least one helical spring 46 that extends between the at least one cross member 42 and the at least one flat spring 30. Accordingly, the at least one helical spring 46 is disposed within the open interior 28 of the furniture frame 24. While the at least one helical spring 46 may take many forms, the at least one helical spring 46 may extend vertically from the at least one cross member 42 to the at least one flat spring 30 in an outwardly opening helix. Thus, the at least one helical spring 46 biases the at least one flat spring 30 toward the support plane S. While a variety of materials may be used, by way of example and without limitation, the at least one helical spring 46 can be made of wire, and more specifically metal wire that has a circular cross-section. Due to its construction and composition, the at least one helical spring 46 is elastic and resilient such that it may compress and/or be deflected when acted on by a force and then spring back to its initial length and/or position when the force is removed. This may occur for example when a person sits or lies on the cushion 22. It should be appreciated that the at least one helical spring 46 of the coil spring bracket apparatus 20 may be a plurality of helical springs 46. Referring again to the example shown in FIG. 1, the at least one helical spring 46 is a plurality of helical springs 46 corresponding to and being aligned with each cross member 42 of the plurality of cross members 42. Accordingly, only the even numbered flat springs 30 (when counting sequentially from left to right) of the plurality of flat springs 30 have a corresponding helical spring 46. It should also be appreciated that multiple helical springs 46 may be disposed along each cross member 42 if desired. A spring fastener 48 may be used to anchor the at least one helical spring 46 to the at least one cross member 42.

Referring again to FIG. 1, a pair of spring couplers 50 may be used to connect the at least one helical spring 46 to the at least one flat spring 30. Each spring coupler 50 of the pair of spring couplers 50 may generally circumscribe portions of the at least one flat spring 30 and the at least one helical spring 46 such that the pair of spring couplers 50 connect the at least one helical spring 46 to the at least one flat spring 30 in two locations where portions of the at least one helical spring 46 and the at least one flat spring 30 overlap and are substantially aligned. The coil spring bracket apparatus 20 may also include a pair of tie wires 52 that span the furniture frame 24 in a direction that is transverse to the at least one flat spring 30. The pair of tie wires 52 can be disposed just below the at least one flat spring 30 on opposite sides of the at least one helical spring 46 to provide additional support for the at least one flat spring 30. Stated another way, the at least one flat spring 30 runs over top of the pair of tie wires 52. As such, the pair of tie wires 52 spread out the load of the force that is applied to adjacent flat springs 30 and/or helical springs 46 and prevent the at least one flat spring 30 from being pushed out of alignment. The pair of tie wires 52 may connected to the at least one flat spring 30 by a pair of wire couplers 54. Each wire coupler 54 of the pair of wire couplers 54 circumscribe portions of the at least one flat spring 30 and one of the tie wires 52 to connect each tie wire 52 of the pair of tie wires 52 to the at least one flat spring 30. Where there is a plurality of flat springs 30, it should be appreciated that wire couplers 54 may be used to connect the tie wires 52 to each one of the flat springs 30 of the plurality of flat springs 30 regardless of whether the flat spring 30 is supported by a corresponding helical spring 46. It should also be appreciated that the pair of tie wires 52 may be used without the pair of wire couplers 54 where the at least one flat spring 30 simply floats on top of the pair of tie wires 52.

Referring generally to FIGS. 4-7, the coil spring bracket apparatus 20 includes a bracket 56 disposed at each of the two opposite ends 44 of the at least one cross member 42. The bracket 56 anchors the at least one cross member 42 to the furniture frame 24. The bracket 56 generally can be described as including a top portion 58, a middle portion 60, and a bottom portion 62. It should be appreciated that the top portion 58, the middle portion 60, and the bottom portion 62 of the bracket 56 may all be integrally formed as part of a uniform piece or may be separate pieces that are joined together to form the bracket 56. While the bracket 56 may be made of a variety of materials, by way of example and without limitation, the bracket 56 may be made of a suitable metal such as steel.

The top portion 58 of the bracket 56 extends outwardly over the furniture frame 24 along the support plane S to an outboard edge 64. As seen in FIG. 1, the top portion 58 of the bracket 56 abuts a portion of the at least one flat spring 30 and thus may be disposed between the at least one flat spring 30 and the furniture frame 24 in an overlapping relationship. Referring again to FIGS. 4-7, the top portion 58 of the bracket 56 may be substantially flat. It should be appreciated that the term "substantially flat," as used herein, is intend to describe a surface that is flat over a majority of its surface area. Accordingly, the term "substantially flat" is intended to encompass surfaces that have small curved portions, channels, protrusions, and/or discontinuities such as holes, groves, and slots. While the top portion 58 of the bracket 56 may take many different shapes without departing from the scope of the present disclosure, by way of example and without limitation, the top portion 58 of the bracket 56 may have a rectangular shape. The top portion 58 of the bracket 56 also defines at least one hole 66. The at least one hole 66 defined by the top portion 58 of the bracket 56 that receives a fastener that anchors the bracket 56 to the furniture frame 24. It should be appreciated that the fastener may take a variety of forms, including without limitation, screws, bolts, nails, staples, pins, and rivets. The at least one hole 66 defined by the top portion 58 of the bracket 56 may be a pair of hole groupings 66 disposed on opposite corners of top portion 58 of the bracket 56 adjacent the outboard edge 64. Each of the hole groupings 66 may include a first hole 68 that is circular and a second hole 70 that is laterally spaced from the first hole 68. The second hole 70 may be elongated to form a slot to accommodate fasteners of different sizes such as staples having different widths.

Figure 4:
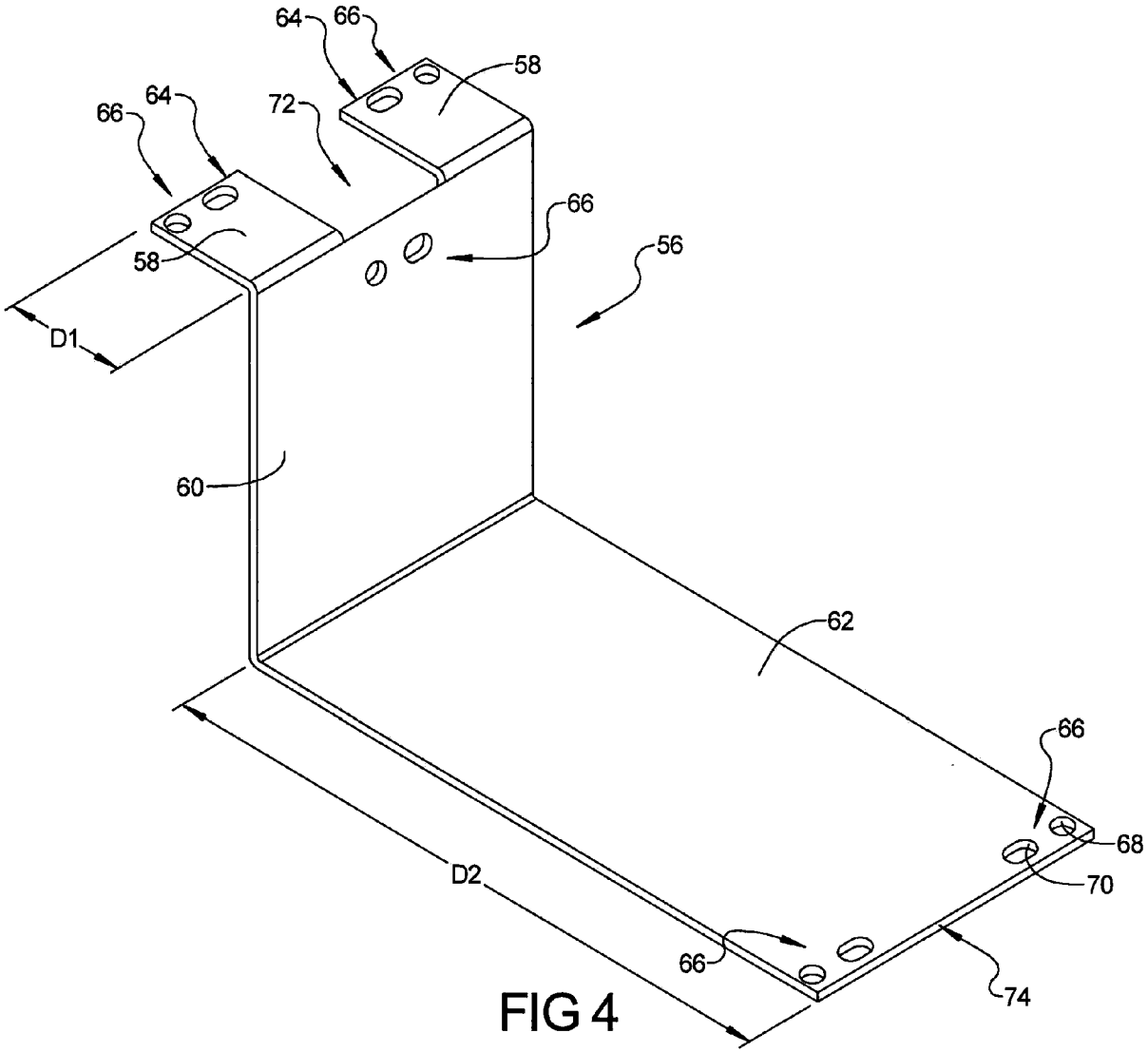
FIG. 4 is a front perspective view of an exemplary bracket constructed in accordance with the present disclosure.
Figure 5:
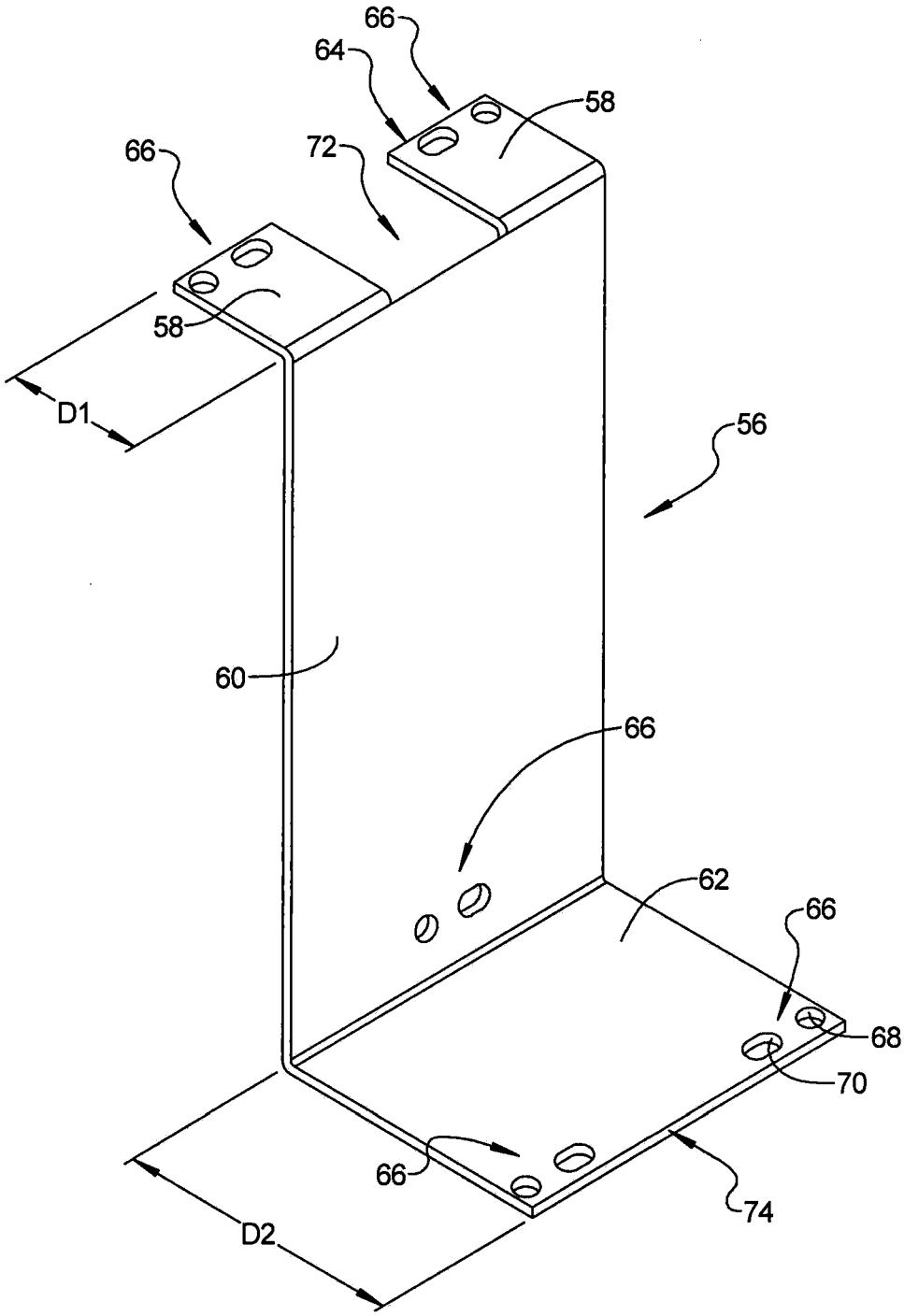
FIG. 5 is a front perspective view of another exemplary bracket constructed in accordance with the present disclosure.
Figure 6:
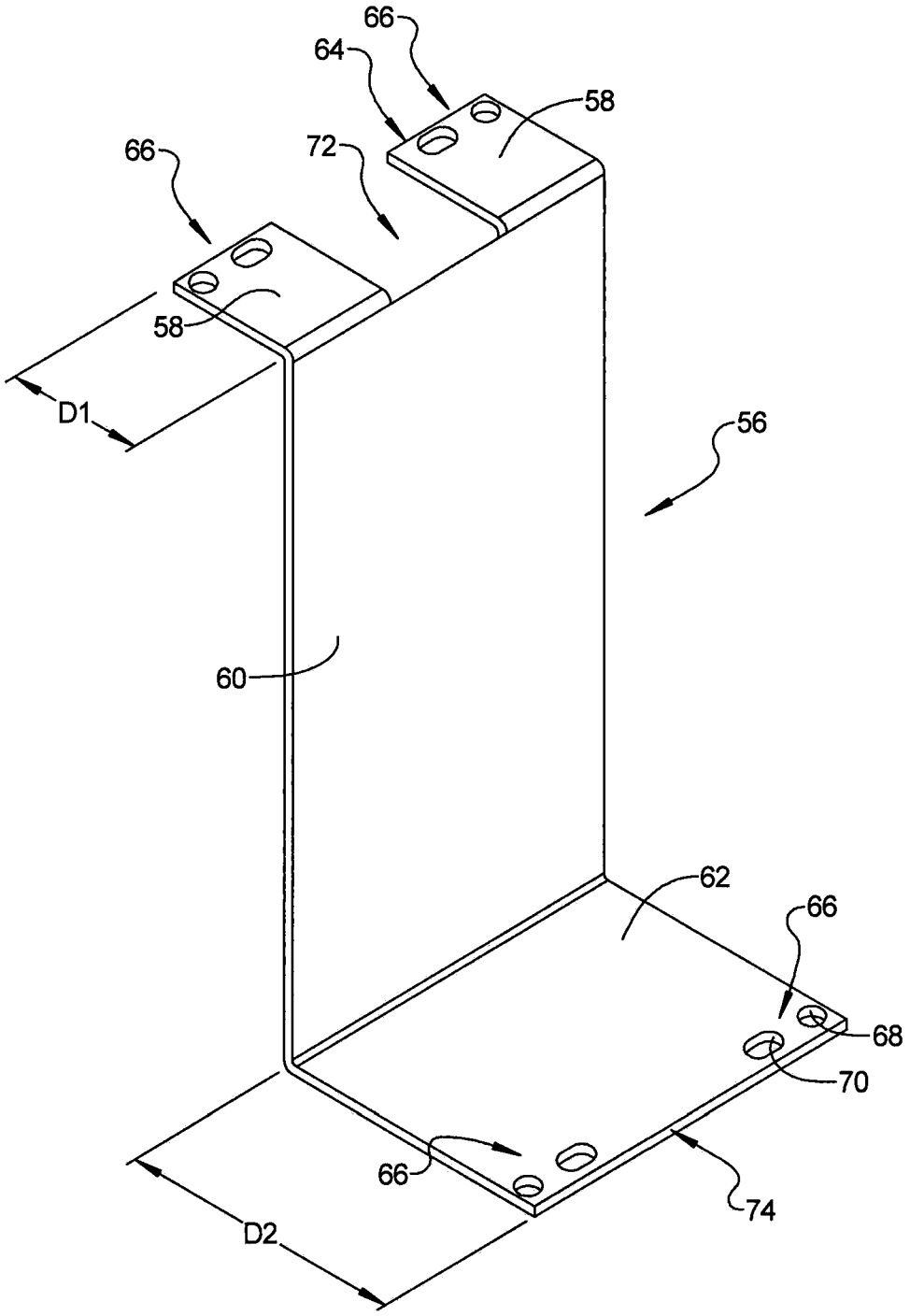
FIG. 6 is a front perspective view of another exemplary bracket constructed in accordance with the present disclosure.

With reference to FIGS. 4-6, the top portion 58 of the bracket 56 may include a cut-out 72 that receives and/or accommodates the spring clip 34. The cut-out 72 may be centrally located on the top portion 58 of the bracket 56. The cut-out 72 may be closed to the outboard edge 64 such that the spring clip 34 is circumscribed by the cut-out 72. Alternatively, the cut-out 72 may extend to the outboard edge 64 of the top portion 58. In this configuration, the cut-out 72 is open to the outboard edge 64 such that the cut-out 72 receives the spring clip 34 in interleaving engagement. It should be appreciated that the cut-out 72 in the top portion 58 of the bracket 56 is advantageous where the furniture frame 24 has limited depth and thus where there is little room for mounting both the top portion 58 of the bracket 56 and the spring clip 34. In other words, the cut-out 72 allows for installation of the bracket 56 and the spring clip 34 on small furniture frames 24. Notwithstanding these benefits, the bracket 56 may be provided without the cut-out 72 as shown in FIG. 7.

Figure 7:
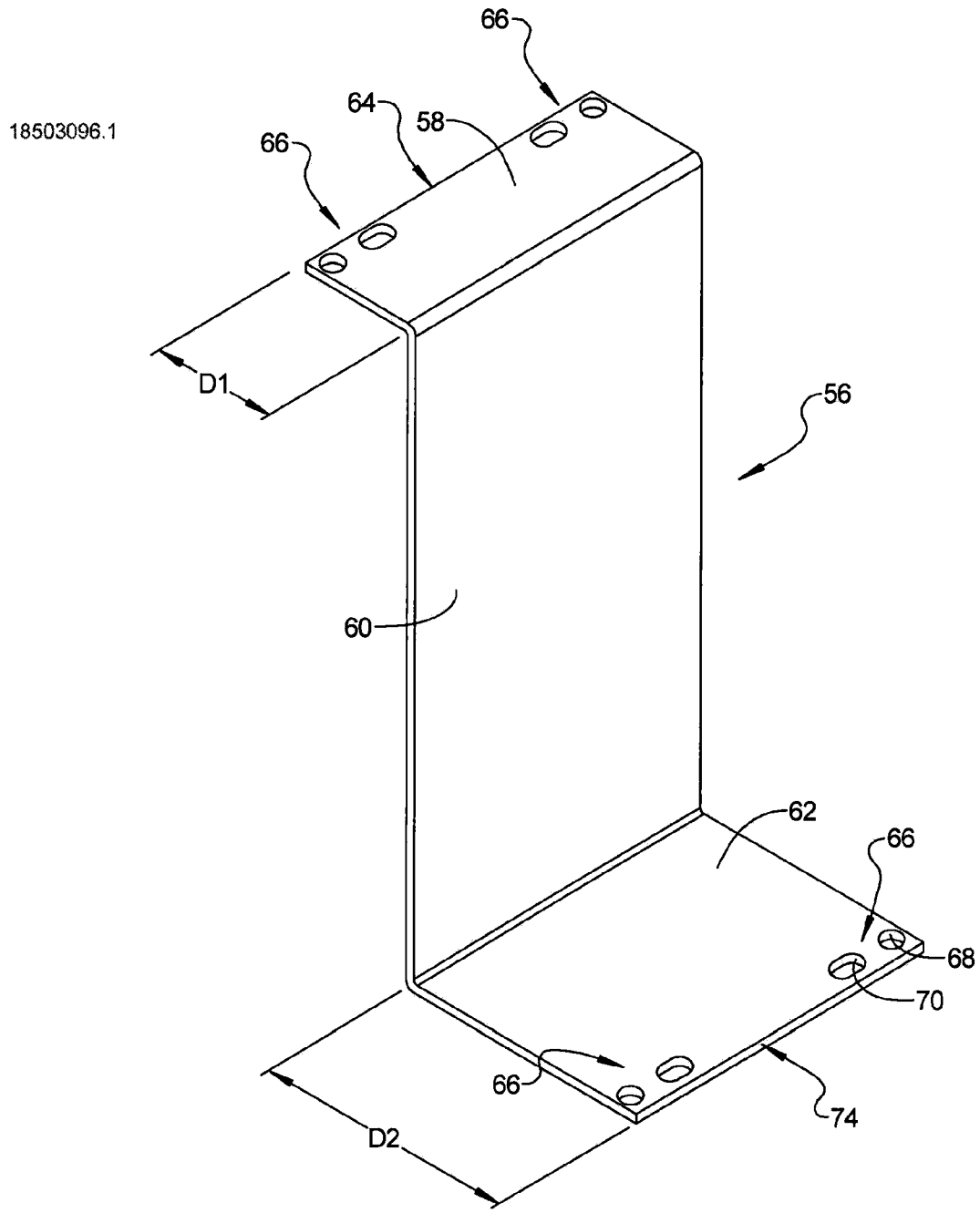
FIG. 7 is a front perspective view of another exemplary bracket constructed in accordance with the present disclosure.

Still referring generally to FIGS. 4-7, the middle portion 60 of the bracket 56 is rectangular in shape and extends into the open interior 28 of the furniture frame 24. The middle portion 60 of the bracket 56 may be perpendicular to the top portion 58 of the bracket 56 and may be substantially flat. In this way, the top portion 58 of the bracket 56 and the middle portion 60 of the bracket 56 can sit flush with the furniture frame 24 where the support members 26 are made of plywood or another material having a rectangular cross-section. As shown in FIGS. 4 and 5, the middle portion 60 of the bracket 56 may optionally define at least one hole 66. The at least one hole 66 can receives a fastener to anchor the bracket 56 to the furniture frame 24. It should be appreciated that the fastener may take a variety of forms, including without limitation, screws, bolts, nails, staples, pins, and rivets. The at least one hole 66 defined by the middle portion 60 of the bracket 56 may be a hole grouping 66. The hole grouping 66 defined by the middle portion 60 of the bracket 56 may include a first hole 68 that is circular and a second hole 70 that is laterally spaced from the first hole 68. The second hole 70 may be elongated to form a slot to accommodate fasteners of different sizes, such as staples having different widths. As shown in FIG. 4, the hole grouping 66 defined by the middle portion 60 of the bracket 56 may be disposed adjacent to the top portion 58 of the bracket 56. As shown in FIG. 5, the hole grouping 66 defined by the middle portion 60 of the bracket 56 may alternatively be disposed adjacent to the bottom portion 62 of the bracket 56. It should also be appreciated that the at least one hole 66 in the middle portion 60 of the bracket 56 is optional and that the middle portion 60 of the bracket 56 may not have any holes as shown in FIGS. 6 and 7.

Again referring generally to FIGS. 4-7, the bottom portion 62 of the bracket 56 extends inwardly from the middle portion 60 of the bracket 56 to an inboard edge 74. As such, the bottom portion 62 of the bracket 56 is disposed within the open interior 28 of the furniture frame 24. While various arrangements and shapes are possible, the bottom portion 62 of the bracket 56 may extend from the middle portion 60 of the bracket 56 at a perpendicular angle and have a rectangular shape. The bottom portion 62 of the bracket 56 may be substantially flat such that the bottom portion 62 of the bracket 56 abuts a portion of the at least one cross member 42 in overlapping relationship. Accordingly, the top portion 58 of the bracket 56 supports the bracket 56 on the furniture frame 24, the bottom portion 62 of the bracket 56 supports one of the two opposite ends 44 of the at least one cross member 42, and the middle portion 60 of the bracket 56 connects the top portion 58 of the bracket 56 to the bottom portion 62 of the bracket 56.

The bottom portion 62 of the bracket 56 may extend further from the middle portion 60 of the bracket 56 than the top portion 58 of the bracket 56. In other words, the top portion 58 of the bracket 56 may extend outwardly from the middle portion 60 of the bracket 56 along a first distance D1. Meanwhile, the bottom portion 62 of the bracket 56 may extend inwardly from the middle portion 60 of the bracket 56 along a second distance D2 that is greater than the first distance D1. This may be beneficial as it increases the overlap between the bottom portion 62 of the bracket 56 and the at least one cross member 42. The bottom portion 62 of the bracket 56 may define at least one hole 66 that receives a fastener to anchor the bracket 56 to the at least one cross member 42. It should be appreciated that the fastener may take a variety of forms, including without limitation, screws, bolts, nails, staples, pins, and rivets. The at least one hole 66 defined by the bottom portion 62 of the bracket 56 may be a pair of hole groupings 66 disposed on opposite corners of the bottom portion 62 adjacent the inboard edge 74. Each of the hole groupings 66 defined by the bottom portion 62 of the bracket 56 may include a first hole 68 that is circular and a second hole 70 that is laterally spaced from the first hole 68. The second hole 70 may be elongated to form a slot to accommodate fasteners of different sizes, such as staples having different widths. Advantageously, the disclosed coil spring bracket apparatus 20 may be universally used with a wide variety of furniture frames 24 that come in different shapes and sizes. The at least one cross member 42 can be easily cut to size to accommodate any particular furniture frame 24 while the bracket 56 itself remains unchanged. Accordingly, this simplifies manufacturing and assembly and the bracket 56 can be produced in large quantities to further reduce cost.

The foregoing description of the embodiments has been provided for the purposes of illustration and description. It is not intended to be exhaustive or limiting. Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims. It should be noted that the word "said" does not precede the terms "cushion" and "furniture frame" in the appended claims, as these terms are not intended to be treated as a positive recitation. That is, the cushion 22 and furniture frame 24 are not meant to be included in the coverage of the claims. It should be appreciated that in use, the disclosed coil spring bracket apparatus 20 is intended to be installed in a furniture frame 24 for the purpose of supporting a cushion 22; however, the appended claims are directed to the structure of the disclosed coil spring bracket apparatus 20 itself and the presence or absence of the furniture frame 24 and/or the cushion 22 is not meant to be a condition required by the appended claims.

What is claimed is:

1. A coil spring bracket apparatus that supports a cushion on a furniture frame comprising:

at least one flat spring spanning the furniture frame, said at least one flat spring extending between two opposite ends and along a support plane wherein the cushion is supported on said support plane;

at least one cross member spanning the furniture frame that extends between two opposite ends and that is aligned with and spaced from said at least one flat spring;

at least one helical spring extending from said at least one cross member to said at least one flat spring to bias said at least one flat spring toward said support plane;

a bracket disposed at each of said two opposite ends of said at least one cross member anchoring said at least one cross member to the furniture frame;

said bracket including a top portion extending outwardly over the furniture frame along said support plane to an outboard edge, a middle portion extending from said top portion into the furniture frame, and a bottom portion extending inwardly from said middle portion to abut a portion of said at least one cross member in an overlapping relationship;

a spring clip disposed at each of said two opposite ends of said at least one flat spring anchoring said two opposite ends of said at least one flat spring to the furniture frame; and a cut-out, centrally located in said top portion of said bracket, that extends to said outboard edge of said top portion of said bracket such that said cut-out is open to said outboard edge of said bracket and receives said spring clip in interleaving engagement.

2. A coil spring bracket apparatus as set forth in claim 1 wherein said top portion of said bracket extends outwardly from said middle portion of said bracket along a first distance and said bottom portion of said bracket extends inwardly from said middle portion of said bracket along a second distance that is greater than said first distance.

3. A coil spring bracket apparatus as set forth in claim 1 wherein said top portion of said bracket is disposed between said at least one flat spring and the furniture frame in an overlapping relationship.

4. A coil spring bracket apparatus as set forth in claim 1 wherein said middle portion of said bracket is disposed at perpendicular angles to said bottom portion of said bracket and said top portion of said bracket.

5. A coil spring bracket apparatus as set forth in claim 1 wherein said spring clip includes a clip base that is flat and a channel protruding upwardly from said clip base that clamps a portion of said at least one flat spring against the furniture frame.

6. A coil spring bracket apparatus as set forth in claim 1 wherein said at least one flat spring has a sinusoidal shape.

7. A coil spring bracket apparatus as set forth in claim 6 wherein said at least one flat spring is a plurality of flat springs evenly spaced across the furniture frame.

8. A coil spring bracket apparatus as set forth in claim 7 wherein said at least one cross member is a plurality of cross members corresponding to and being aligned with every other flat spring of said plurality of flat springs.

9. A coil spring bracket apparatus as set forth in claim 8 wherein said at least one helical spring is a plurality of helical springs corresponding to and being aligned with each cross member of said plurality of cross members.

10. A coil spring bracket apparatus as set forth in claim 1 wherein said at least one helical spring extends in an outwardly opening helix.

11. A coil spring bracket apparatus as set forth in claim 1 further comprising:

a pair of spring couplers circumscribing portions of said at least one flat spring and said at least one helical spring to interconnect said at least one helical spring and said at least one flat spring in two locations.

12. A coil spring bracket apparatus as set forth in claim 1 further comprising:

a pair of tie wires spanning said furniture frame in a direction that is transverse to said at least one flat spring wherein said pair of tie wires are disposed just below said at least one flat spring on opposite sides of said at least one helical spring to support said at least one flat spring.

13. A coil spring bracket apparatus as set forth in claim 12 further comprising:

a pair of wire couplers circumscribing portions of said at least one flat spring and said pair of tie wires to connect said pair of tie wires to said at least one flat spring.

14. A coil spring bracket apparatus that supports a cushion on a furniture frame comprising:

a plurality of flat springs spanning the furniture frame, said plurality of flat springs being evenly spaced across the furniture frame and sequentially arranged to include even and odd numbered flat springs;

a plurality of cross members spanning the furniture frame, each cross member extending between two opposite ends, and said plurality of cross members being aligned with only said even numbered flat springs;

a plurality of helical springs supported on said plurality of cross members, each helical spring extending between one of said cross members and one of said even numbered flat springs;

a bracket disposed at each of said two opposite ends of said at least one cross member anchoring said at least one cross member to the furniture frame; and said bracket including a top portion extending outwardly over the furniture frame along said support plane and a middle portion extending from said top portion into the furniture frame and a bottom portion extending inwardly from said middle portion to abut a portion of said at least one cross member in an overlapping relationship.

15. A coil spring bracket apparatus as set forth in claim 14 wherein said top portion of said bracket extends outwardly from said middle portion of said bracket along a first distance and said bottom portion of said bracket extends inwardly from said middle portion of said bracket along a second distance that is greater than said first distance.

16. A coil spring bracket apparatus as set forth in claim 14 wherein said middle portion of said bracket is disposed at perpendicular angles to said bottom portion of said bracket and said top portion of said bracket.

17. A coil spring bracket apparatus as set forth in claim 14 wherein said at least one helical spring extends in an outwardly opening helix.

18. A coil spring bracket apparatus that attaches a cross member to a furniture frame comprising:

a bracket including a top portion and middle portion and a bottom portion;

said top portion of said bracket being substantially flat and extending outwardly over the furniture frame to an outboard edge;

said middle portion of said bracket being substantially flat and extending perpendicularly to said top portion of said bracket;

said bottom portion of said bracket being substantially flat and extending inwardly from said middle portion of said bracket at a perpendicular angle to an inboard end wherein said bottom portion of said bracket abuts a portion of the cross member in overlapping relationship; and at least one of said top portion and said bottom portion of said bracket defining a hole grouping that receives a fastener to anchor said bracket to the furniture frame or the cross-member, said hole grouping including a first hole that is circular and a second hole that is laterally spaced from said first hole and that is elongated to form a slot.

19. A coil spring bracket apparatus as set forth in claim 18 wherein said bottom portion of said bracket extends further from said middle portion of said bracket than said top portion of said bracket.

20. A coil spring bracket apparatus as set forth in claim 18 wherein said top portion of said bracket includes a cut-out centrally located in said top portion of said bracket that extends to said outboard edge.

21. A coil spring bracket apparatus as set forth in claim 18 wherein said middle portion of said bracket defines at least one hole that receives a fastener to anchor said bracket to the furniture frame.

22. A coil spring bracket apparatus as set forth in claim 21 wherein said at least one hole defined by said middle portion of said bracket is a hole grouping including a first hole that is circular and a second hole that is laterally spaced from said first hole and that is elongated to form a slot.

23. A coil spring bracket apparatus as set forth in claim 22 wherein said hole grouping defined by said middle portion of said bracket is disposed along said middle portion of said bracket in a region adjacent to one of: (a) said bottom portion of said bracket and (b) said top portion of said bracket.

24. A coil spring bracket apparatus as set forth in claim 18 wherein a pair of hole groupings are disposed on opposite corners of said top portion of said bracket adjacent to said outboard edge with each of said hole groupings including a first hole that is circular and a second hole that is elongated to form a slot.

25. A coil spring bracket apparatus as set forth in claim 18 wherein a pair of hole groupings are disposed on opposite corners of said bottom portion of said bracket adjacent to said inboard edge with each of said hole groupings including a first hole that is circular and a second hole that is elongated to form a slot.

* * * * *